US011879195B2

(12) United States Patent
Jiang

(10) Patent No.: US 11,879,195 B2
(45) Date of Patent: Jan. 23, 2024

(54) AUTOMATIC THREAD TRIMMING DEVICE OF SEWING MACHINE

(71) Applicant: Yan-Hong Jiang, Changhua (TW)

(72) Inventor: Yan-Hong Jiang, Changhua (TW)

(73) Assignee: HONGCHENG PRECISION INDUSTRY CO., LTD., Changhua County (TW)

( * ) Notice: Subject to any disclaimer, the term of this patent is extended or adjusted under 35 U.S.C. 154(b) by 80 days.

(21) Appl. No.: 17/684,641

(22) Filed: Mar. 2, 2022

(65) Prior Publication Data

US 2023/0279598 A1 Sep. 7, 2023

(51) Int. Cl.
*D05B 65/00* (2006.01)

(52) U.S. Cl.
CPC ..... *D05B 65/00* (2013.01)

(58) Field of Classification Search
CPC .... D05B 65/00; D05B 65/0003; D05B 73/12; D05C 11/20
See application file for complete search history.

(56) References Cited

U.S. PATENT DOCUMENTS 5,415,119 A * 5/1995 Ikeda ..... D05B 65/00 112/296
6,062,152 A * 5/2000 Yu ..... D05B 65/00 112/291
2007/0039530 A1* 2/2007 Koike ..... D05B 69/30 112/29
2009/0199753 A1* 8/2009 Niizeki ..... D05B 65/00 112/292

FOREIGN PATENT DOCUMENTS

CH 416285 A * 6/1966 ..... D05B 65/003
DE 102009016472 A1 * 10/2009 ..... D05B 47/00
EP 2228477 A2 * 9/2010 ..... D05B 65/00
JP 5312130 B2 * 10/2013 ..... D05B 37/04

* cited by examiner

*Primary Examiner* — Alissa L Hoey
*Assistant Examiner* — Patrick J. Lynch
(74) *Attorney, Agent, or Firm* — Che-Yang Chen; Law Office of Michael Chen

(57) ABSTRACT

An automatic thread trimming device of a sewing machine contains: a holding disc, a cutter assembly, a fixed cutter, and a protective sheet. The automatic thread trimming device further contains an abutting segment formed on a distal portion of a curved section of a front end of an elastic extension and corresponding to a contact zone of a movable cutter, such that the movable cutter moves to the fixed cutter horizontally to produce cutting force. In the meantime, a longitudinal thickness of a protrusion corresponding to a receiving orifice is 0.5 mm so that a short thread end is cut between a thread and a cut portion of the thread, and the short thread end retracts inward because of a woven fabric, thus obtaining a flatness of a sewing product. Preferably, the automatic thread trimming device is capable of being driven by drive elements of any sewing machines.

7 Claims, 12 Drawing Sheets

AUTOMATIC THREAD TRIMMING DEVICE OF SEWING MACHINE

FIELD OF THE INVENTION

The present invention relates to an automatic thread trimming device of a sewing machine which is capable of cutting a short thread end, and the automatic thread trimming device is applicable for sewing machines of various brands.

BACKGROUND OF THE INVENTION

The conventional sewing machine is a used for tailoring and sewing the sewing thread on the fabric. The sewing machine contains a cutting structure for cutting the sewing thread. When the user is desired to cut the sewing thread, the needle leaves the fabric, and the sewing machine drives the cutting mechanism to cut the sewing thread. However, the cutting structure of the conventional sewing machine has the following problem:

Conventionally, the sewing machine of each brand has different actuation elements, the cutters of different brands cannot be shared.

The present invention has arisen to mitigate and/or obviate the afore-described disadvantages.

SUMMARY OF THE INVENTION

The primary objective of the present invention is to provide an automatic thread trimming device of a sewing machine which is capable of cutting a short thread end, and the automatic thread trimming device is applicable for sewing machines of various brands.

Another objective of the present invention is to provide an automatic thread trimming device of a sewing machine which is applicable for sewing machines of various brands.

To obtain above-mentioned aspects, an automatic thread trimming device of a sewing machine provided by the present invention contains: a holding disc, a cutter assembly, a fixed cutter, and a protective sheet.

The holding disc includes a groove in which a protrusion extending from a predetermined position of the groove, a receiving orifice formed on a predetermined position of the protrusion, an accommodation portion formed beside the receiving orifice, and a coupling portion formed on a side of the accommodation portion. The groove has a first defining orifice and a second defining orifice which are formed on two predetermined positions of the groove, and a first connection portion and a second connection portion are formed on two ends of the groove. The first connection portion has a first flexible connection element, and second connection portion has a second flexible connection element.

The cutter assembly is slidably received in the groove of the holding disc, and the cutter assembly includes a drive bar and a movable blade, the movable blade has a guide rib extending from a side thereof, a tiled guiding face formed on a bottom of the guide rib, and an abutting section formed on a top of the movable blade, such that the movable blade is slidably aligned with the receiving orifice of the holding disc, and the cutter assembly further includes a trench corresponding to the second flexible connection element, and the cutter assembly includes a push face corresponding to the first flexible connection element, such that the trench of the cutter assembly is engaged with the first flexible connection element, and the push face of the cutter assembly abuts against the second flexible connection element.

The fixed cutter is mounted in the accommodation portion of the holding disc, and the cutter assembly includes an arcuate guiding face formed on an end of the cutter assembly and corresponding to the receiving orifice of the holding disc. The arcuate guiding face has a fixed blade formed on an end thereof and corresponding to the movable blade, such that the movable blade moves to the receiving orifice with the fixed blade to cut a thread. The arcuate guiding face contacts with the tiled guiding face of the movable blade after the movable blade moves, the fixed cutter further includes a fixing segment formed on an end thereof and corresponding to the coupling portion of the holding disc, and the coupling portion is screwed with the fixing segment by using a third threaded bolt.

The protective sheet includes multiple through holes corresponding to multiple defining orifices, such that the multiple defining orifices and the multiple through holes are screwed by way of a fourth threaded bolt, and the protective sheet covers the cutter assembly. The drive bar and the receiving orifice expose, the protective sheet includes a stop face corresponding to the drive bar, such that the drive bar is limited on the stop face.

The protective sheet further includes an elastic extension extending therefrom and corresponding to the movable blade, the elastic extension has a flexible curved section bending downward from a front end thereof, and the flexible curved section has a flexible biasing segment formed on a distal end thereof and corresponding to the abutting section of the movable cutter, the movable blade is pressed longitudinally by using the abutting section and the flexible biasing segment of the elastic extension, such that the movable blade accumulates an elasticity to bounce away, and the movable blade produces a cutting force with the fixed blade, when moving to the fixed blade horizontally.

DETAILED DESCRIPTION OF THE PREFERRED EMBODIMENTS

Figure 1:
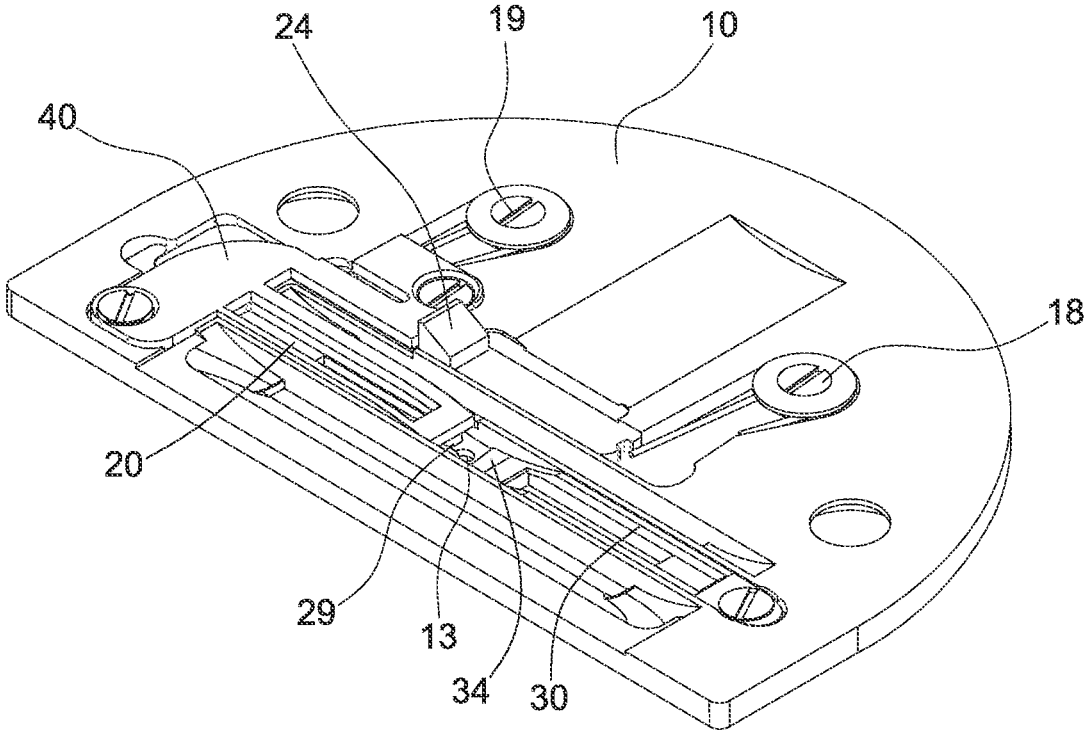
FIG. 1 is a perspective view showing the assembly of an automatic thread trimming device of a sewing machine according to a first embodiment of the present invention.
Figure 2:
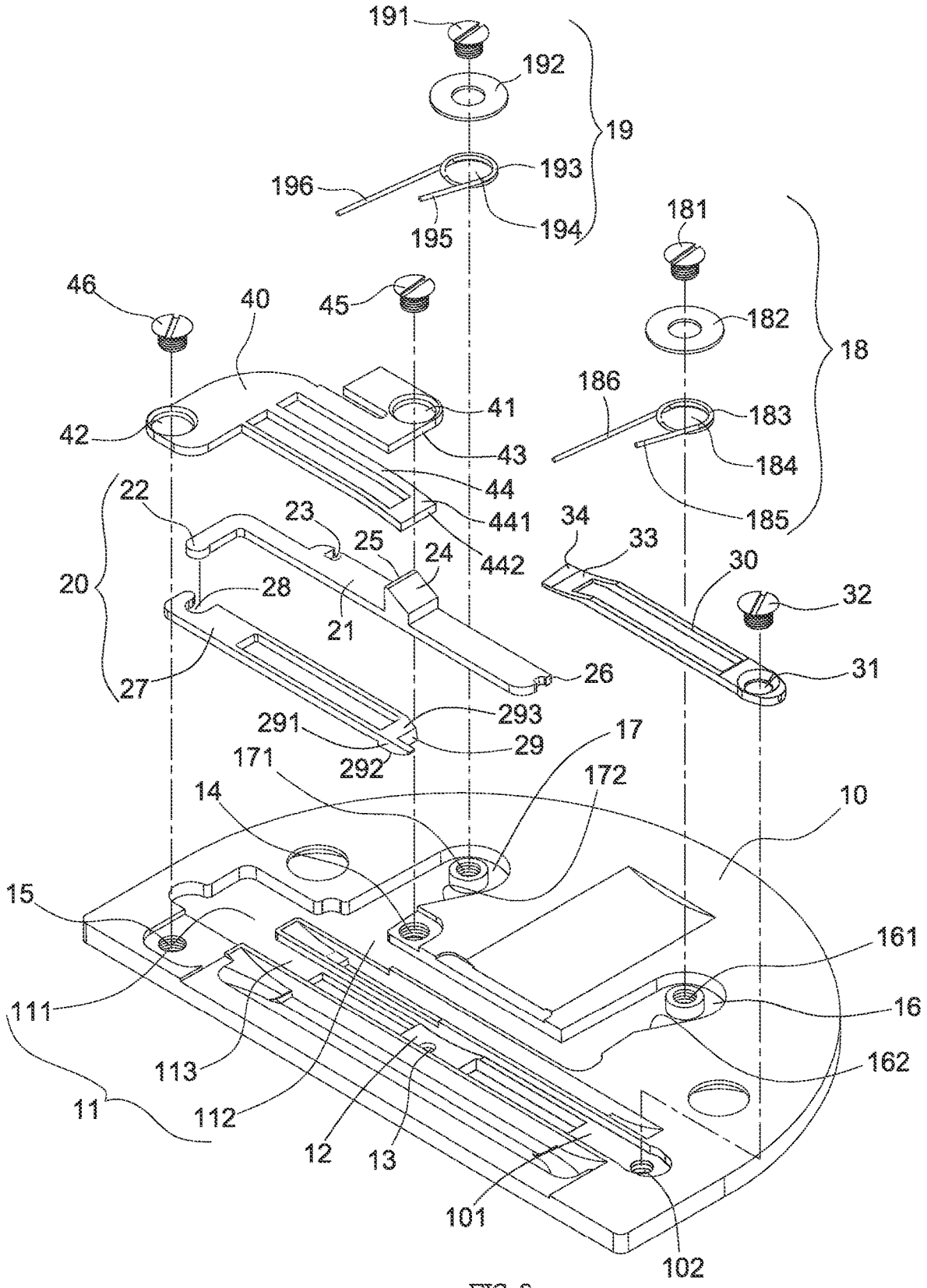
FIG. 2 is a perspective view showing the exploded components of the automatic thread trimming device of the sewing machine according to the first embodiment of the present invention.
Figure 3:
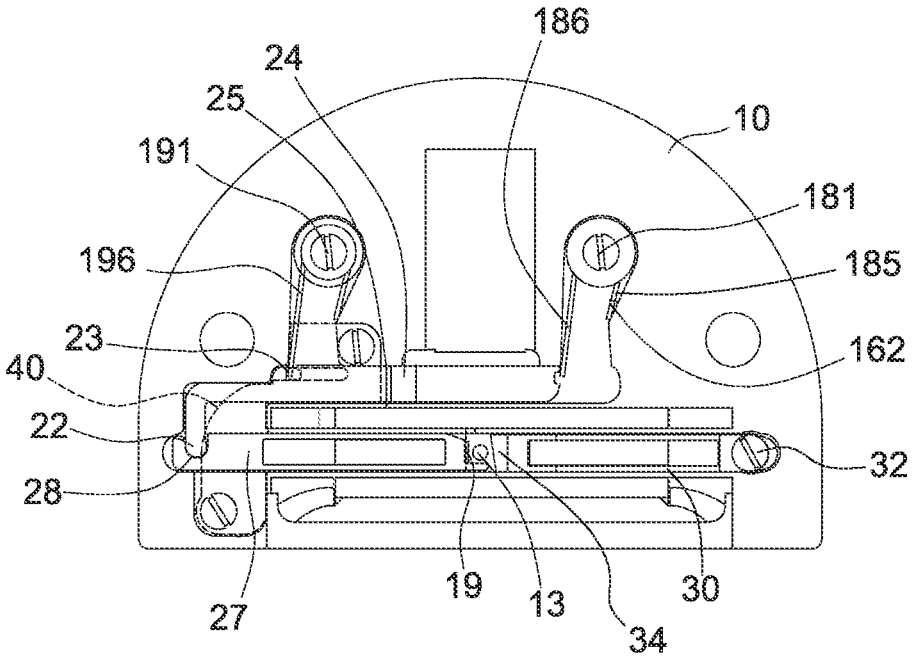
FIG. 3 is a side plane view showing the assembly of the automatic thread trimming device of the sewing machine according to the first embodiment of the present invention.
Figure 4:
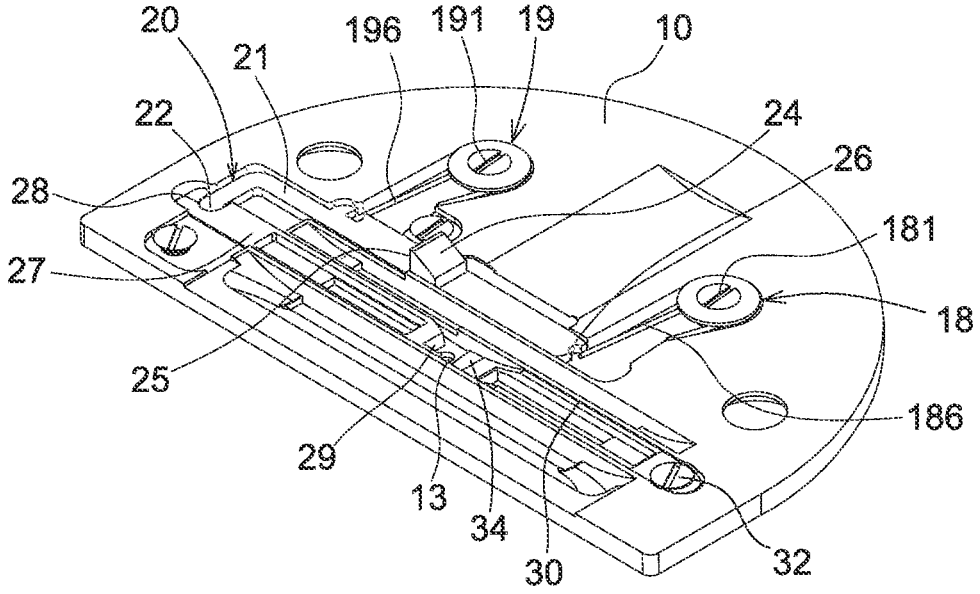
FIG. 4 is a perspective view showing the assembly of a part of the automatic thread trimming device of the sewing machine according to the first embodiment of the present invention.
Figure 5:
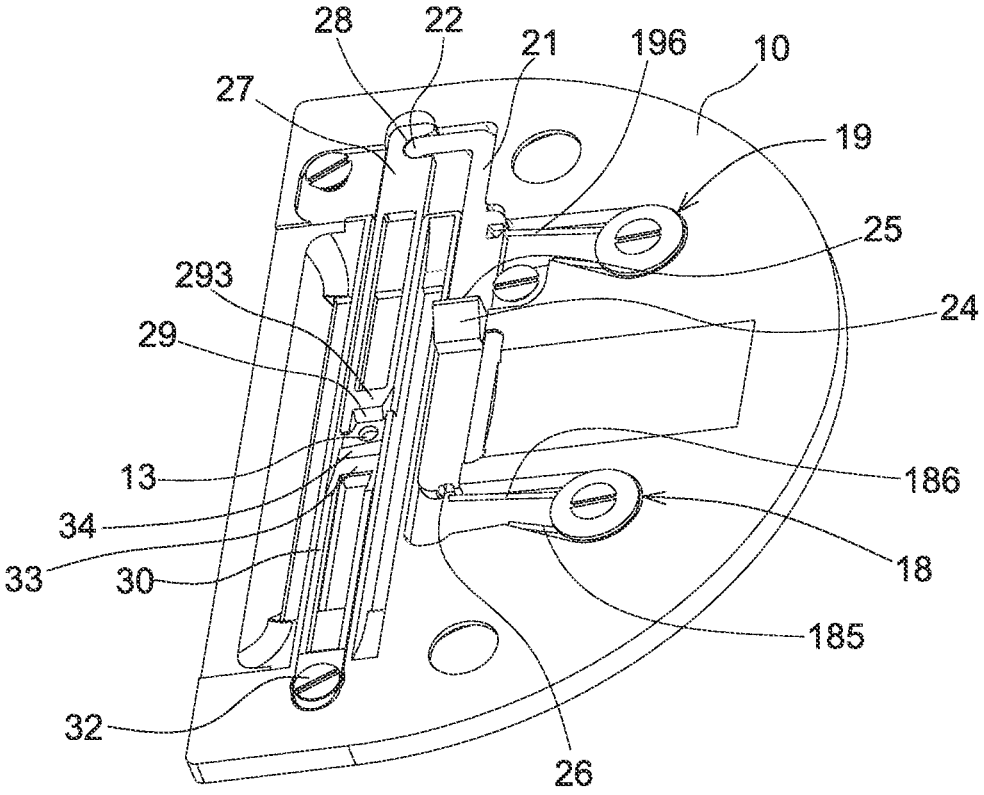
FIG. 5 is a perspective view showing the operation of the automatic thread trimming device of the sewing machine according to the first embodiment of the present invention.
Figure 6:
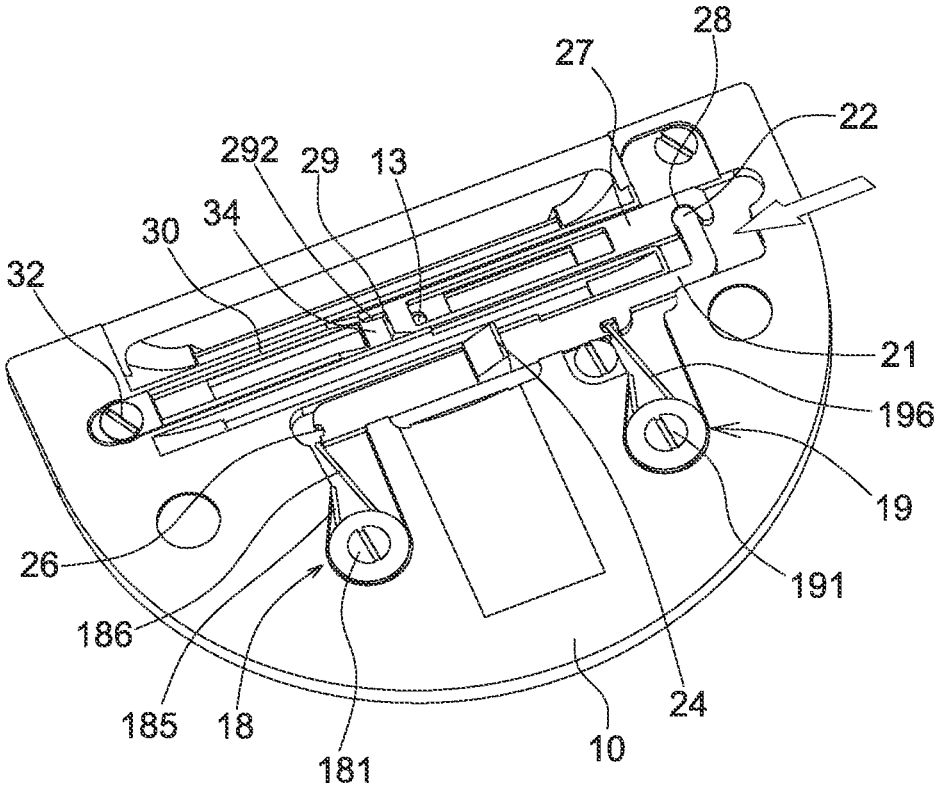
FIG. 6 is another perspective view showing the operation of the automatic thread trimming device of the sewing machine according to the first embodiment of the present invention.
Figure 7:
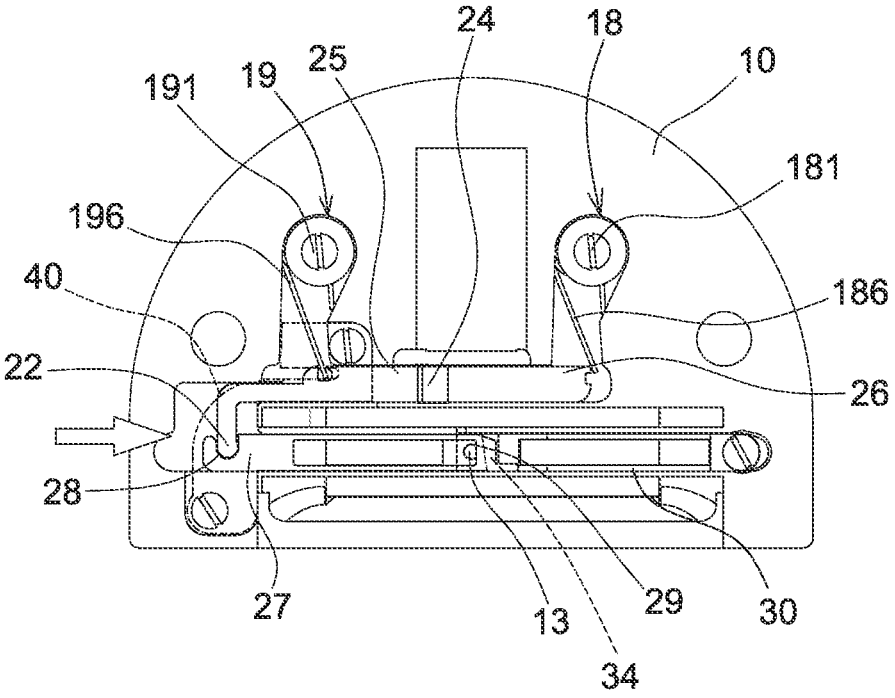
FIG. 7 is a side plan view showing the operation of the automatic thread trimming device of the sewing machine according to the first embodiment of the present invention.
Figure 8:
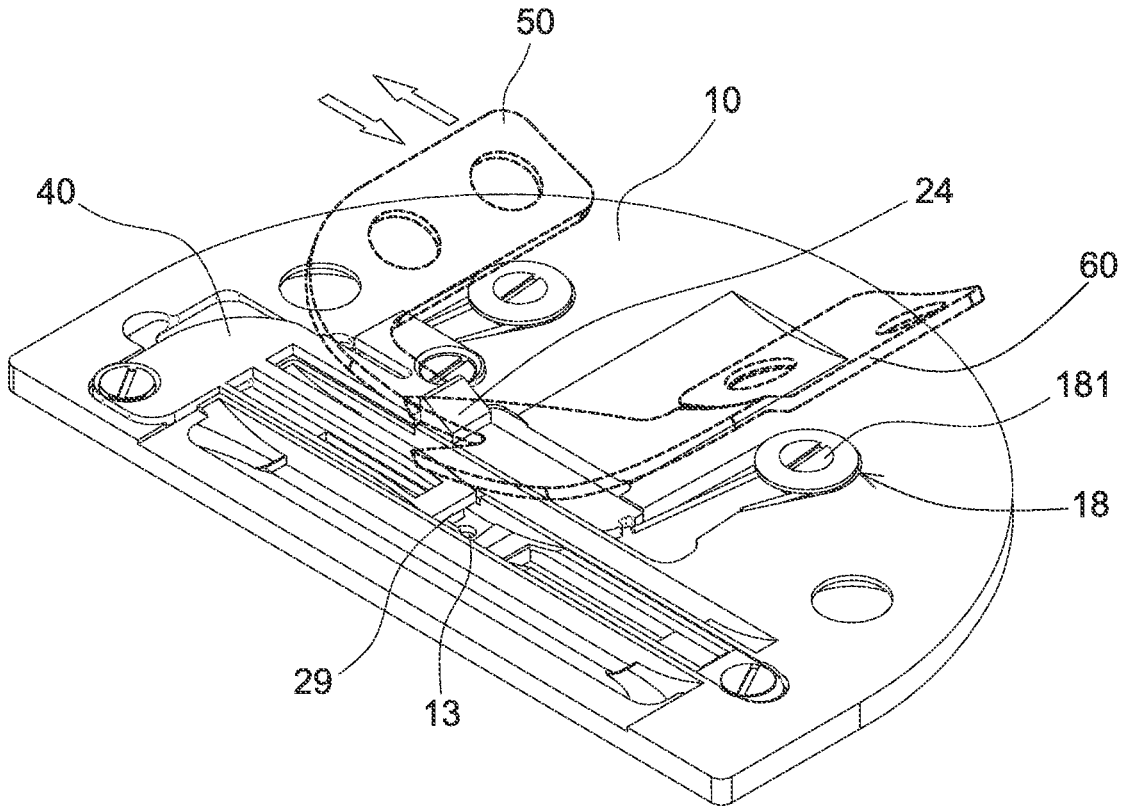
FIG. 8 is a perspective view showing the application of the automatic thread trimming device of the sewing machine according to the first embodiment of the present invention.
Figure 9:
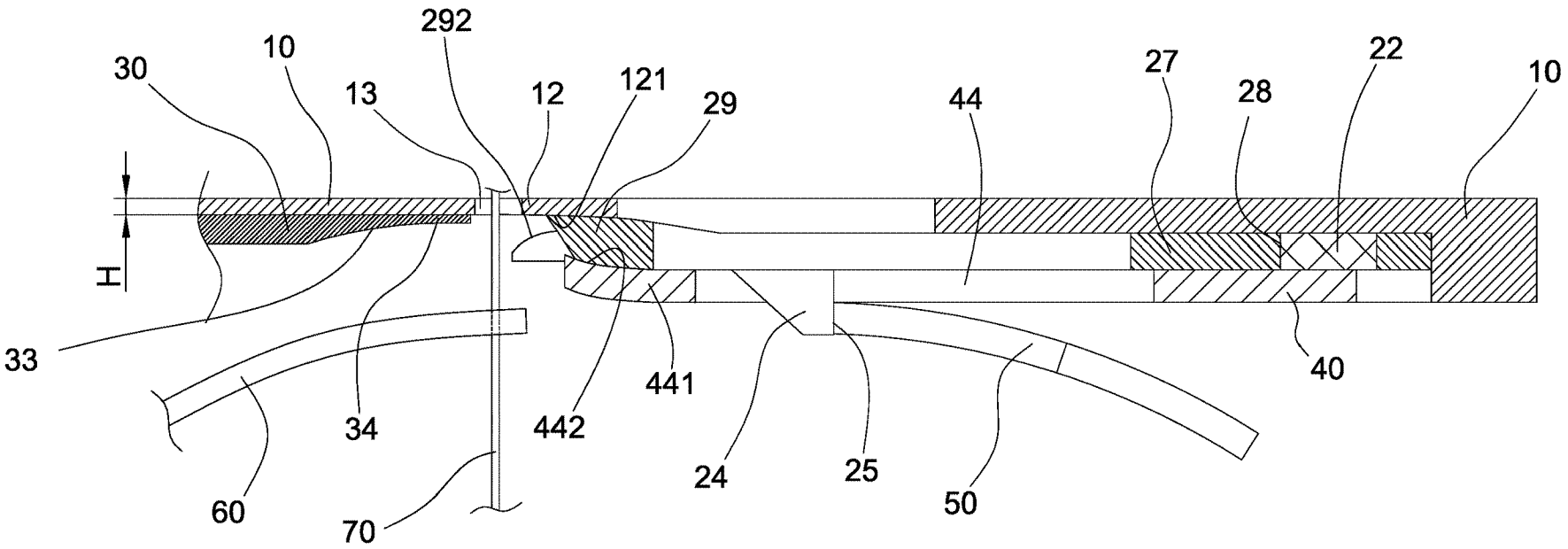
FIG. 9 is a cross sectional view showing the operation of a part of the automatic thread trimming device of the sewing machine according to the first embodiment of the present invention.
Figure 10:
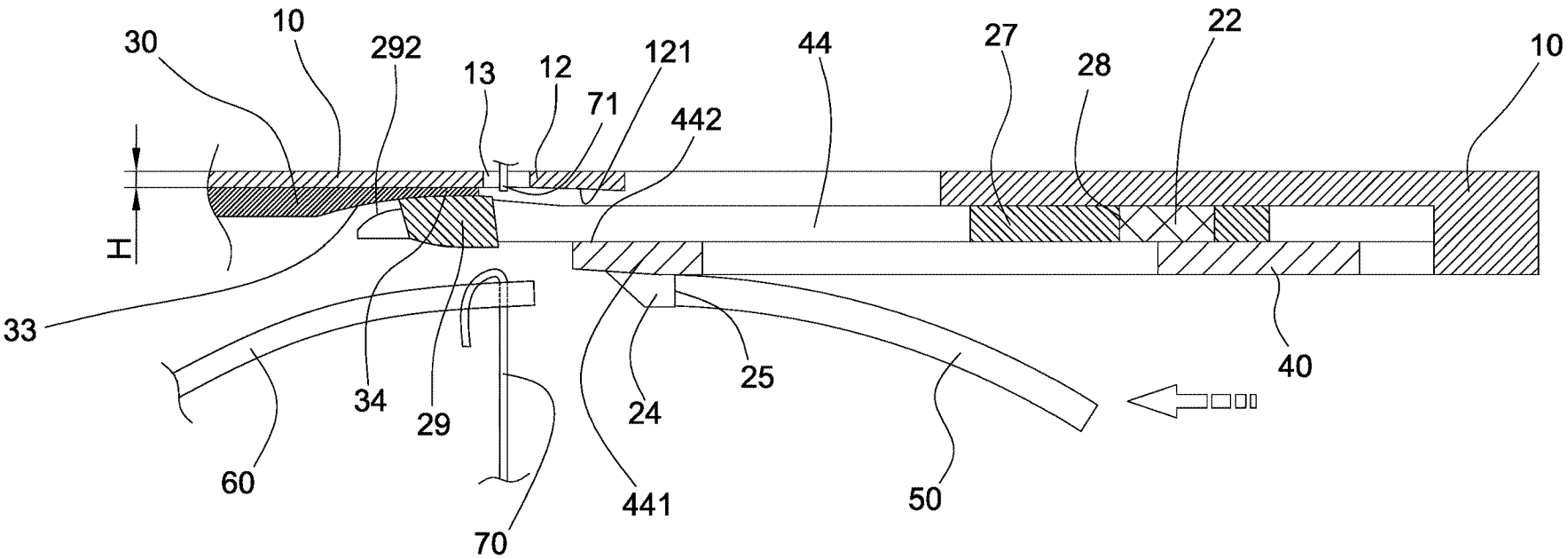
FIG. 10 is another cross sectional view showing the operation of a part of the automatic thread trimming device of the sewing machine according to the first embodiment of the present invention.
Figure 11:
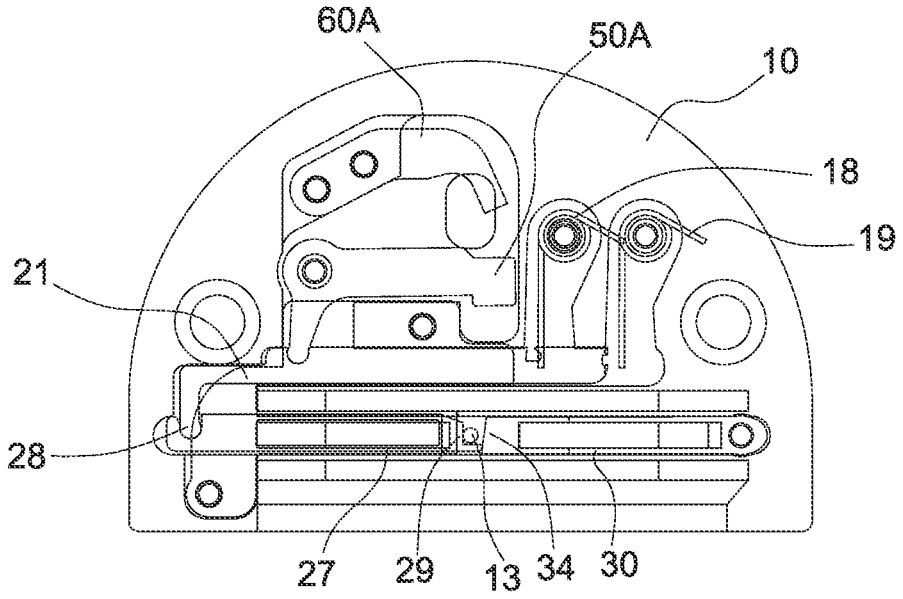
FIG. 11 is a side plan view showing the assembly of the automatic thread trimming device of the sewing machine according to a second embodiment of the present invention.

With reference to FIGS. 1-11, an automatic thread trimming device of a sewing machine according to a first embodiment of the present invention is capable of cutting a short thread end, and the automatic thread trimming device comprises:

a holding disc 10 including a groove 11 in which a protrusion 12 extending from a predetermined position of the groove 11, a receiving orifice 13 formed on a predetermined position of the protrusion 13, wherein a longitudinal thickness H of the protrusion 12 corresponding to the receiving orifice 13 is 0.5 min, an accommodation portion 101 is formed beside the receiving orifice 13, and a coupling portion 102 is formed on a side of the accommodation portion 101, wherein the protrusion 12 has an arcuate face 121 corresponding to the receiving orifice 13, the groove 11 has a first defining orifice 14 and a second defining orifice 15 which are formed on two predetermined positions of the groove 11, and a first connection portion 16 and a second connection portion 17 are formed on two ends of the groove 11;

wherein the first connection portion 16 and the second connection portion 17 are recessed and communicate with the groove 11, the first connection portion 16 has a first connecting extension 161 formed on a predetermined position thereof, a first defining fringe 162 formed on a side of the first connecting extension 161, and the second connection portion 17 has a second connecting extension 171 formed on a predetermined position thereof, a second defining fringe 172 formed on a side of the second connecting extension 171;

wherein the first connecting extension 161 has a first flexible connection element 18, and the second connecting extension 171 has a second flexible connection element 19, wherein the first flexible connection element 18 has a first threaded bolt 181, a first washer 182, a first resilient spring 183, and a first aperture 184 defined on a center of the first resilient spring 183 and configured to receive the first threaded bolt 181 so that the first threaded bolt 181 is rotatable accommodated in the first connecting extension 161 of the holding disc 10, the first washer 182 is fixed between the first connecting extension 161 and the first resilient spring 183, wherein the first resilient spring 183 has a first limiting segment 185 and a first engaging segment 186, the first limiting segment 185 abuts against the first defining fringe 162 of the holding disc 10, and the first engaging segment 186 contacts with a push face 26 of a cutter assembly 20;

wherein the second flexible connection element 19 has a second threaded bolt 191, a second washer 192, a second resilient spring 193, and a second aperture 194 defined on a center of the second resilient spring 193 and configured to receive the second threaded bolt 191 so that the second threaded bolt 191 is rotatably accommodated in the second connecting extension 171 of the holding disc 10, the second washer 192 is fixed between the second connecting extension 171 and the second resilient spring 193, wherein the second resilient spring 193 has a second limiting segment 195 and a second engaging segment 196, wherein the second limiting segment 195 abuts against the second defining fringe 172 of the holding disc 10, and the second engaging segment 196 contacts with a trench 23 of a cutter assembly 20; the groove 11 of the holding disc 10 has a first conduit 112, a second conduit 113, and a communication portion 111 which are formed in a U shape;

wherein the cutter assembly 20 is slidably received in the groove 11 of the holding disc 10, and the cutter assembly 20 includes a drive bar 24 and a movable blade 29, wherein the movable blade 29 has a guide rib 291 extending from a side thereof, a tiled guiding face 292 formed on a bottom of the guide rib 291, and an abutting section 293 formed on a top of the movable blade 29; such that the movable blade 29 is slidably aligned with the receiving orifice 13 of the holding disc 10, wherein the arcuate face 121 of the protrusion 12 corresponds to the movable blade 29, the trench 23 of the cutter assembly 20 corresponds to the second flexible connection element 19, and the push face 26 of the cutter assembly 20 corresponds to the first flexible connection element 18, such that the trench 23 of the cutter assembly 20 is engaged with the first flexible connection element 18, and the push face 26 of the cutter assembly 20 abuts against the second flexible connection element 19;

wherein the drive bar 24 has an actuation face 25 formed on a rear end thereof and configured to drive the cutter assembly 20 so that the movable blade 29 slides linearly toward the receiving orifice 13 of the holding disc 10 to cut a thread, and the first flexible connection element 18 and the second flexible connection element 19 drive the cutter assembly 20 to move back to an original position;

wherein the cutter assembly 20 further includes a driver 21 and a movable cutter 27, the driver 21 corresponds to the first conduit 112 of the holding disc 10, and the movable cutter 27 corresponds to the second conduit 113, wherein a locking segment 22 and a fixing notch 28 are defined between the driver 21 and the movable cutter 27 and are received in the communication portion 111, such that the movable cutter 27 is removed from or is connected with the driver 21 by using the locking segment 22 and the fixing notch 28, and the movable cutter 27 is replaced solely after the movable blade 29 is damaged;

wherein a fixed cutter 30 is mounted in the accommodation portion 101 of the holding disc 10, and the cutter assembly 20 includes an arcuate guiding face 33 formed on an end of the cutter assembly 20 and corresponding to the receiving orifice 13 of the holding disc 10, wherein the arcuate guiding face 33 has a fixed blade 34 formed on an end thereof and corresponding to the movable blade 29, such that the movable blade 29 moves to the receiving orifice 13 with the fixed blade 34 to cut the thread, wherein the arcuate guiding face 33 contacts with the tiled guiding face 292 of the movable blade 29 after the movable blade 29 moves, the fixed cutter 30 further includes a fixing segment 31 formed on an end thereof and corresponding to the coupling portion 102 of the holding disc 10, and the coupling portion 102 is screwed with the fixing segment 31 by using a third threaded bolt 32;

wherein a protective sheet 40 includes a first through hole 41 corresponding to the first defining orifice 14, and the protective sheet 40 includes a second through hole 42 corresponding to the second defining orifice 15, such that the first defining orifice 14 and the first through hole 41 are screwed by way of a fourth threaded bolt 45, the second defining orifice 15 and the second through hole 46 are screwed by way of a fourth threaded bolt 46, and the protective sheet 40 covers the cutter assembly 20, wherein the drive bar 24 and the receiving orifice 13 expose, the protective sheet 40 includes a stop face 43 corresponding to the drive bar 24, such that the drive bar 24 is limited on the stop face 43; wherein the protective sheet 40 further includes an elastic extension 44 extending therefrom and corresponding to the movable blade 29, the movable cutter 27 is linearly slid between the holding disc 10 and the elastic extension 44, wherein the elastic extension 44 has a flexible curved section 441 bending downward from a front end thereof, and the flexible curved section 441 has a flexible biasing segment 442 formed on a distal end thereof and corresponding to the abutting section 293 of the movable cutter 27, the movable blade 29 is pressed longitudinally by using the abutting section 293 and the flexible biasing segment 442 of the elastic extension 44, such that the movable blade 29 accumulates an elasticity to bounce away, and the movable blade 29 produces a cutting force with the fixed blade 34, when moving to the fixed blade 34 horizontally.

With reference to FIGS. 810, the actuation face 25 of the drive bar 24 is driven by an actuation element 50, and a supplement element 60 contacts with the thread in a right driving mode so that the cutter assembly 20 is actuated linearly, and the driver 21 actuates the fixing notch 28 of the movable cutter 27 by using the locking segment 22 so that the movable blade 29 of the movable cutter 27 is slid linearly toward the receiving orifice 13 so as to cut the thread with the fixed blade 34, and the flexible curved section 441 has a flexible biasing segment 442 formed on a distal end of the flexible curved section 441 of a front end of the elastic extension 44, wherein the flexible biasing segment 442 corresponds to the abutting section 293 of the movable cutter 27, and the movable blade 29 produces a cutting force with the fixed blade 34, when moving to the fixed blade 34 horizontally. The longitudinal thickness H of the protrusion 12 corresponding to the receiving orifice 13 is 0.5 mm so that a short thread end is cut between the thread 70 and a cut portion 71 of the thread 70, and the short thread end retracts inward because of a woven fabric, thus obtaining a flatness of a sewing product. Preferably, the cutter assembly 20 moves to the original position efficiently by way of the first flexible connection element 18 and the second flexible connection element 19, after cutting the thread end Referring to FIG. 11, in a second embodiment, the actuation element 50A and the supplement element 60A are arranged above and below the holding disc 10 so that the movable blade 29 of the movable cutter 27 is moved horizontally to be applicable for sewing machines of various brands.

Figure 12:
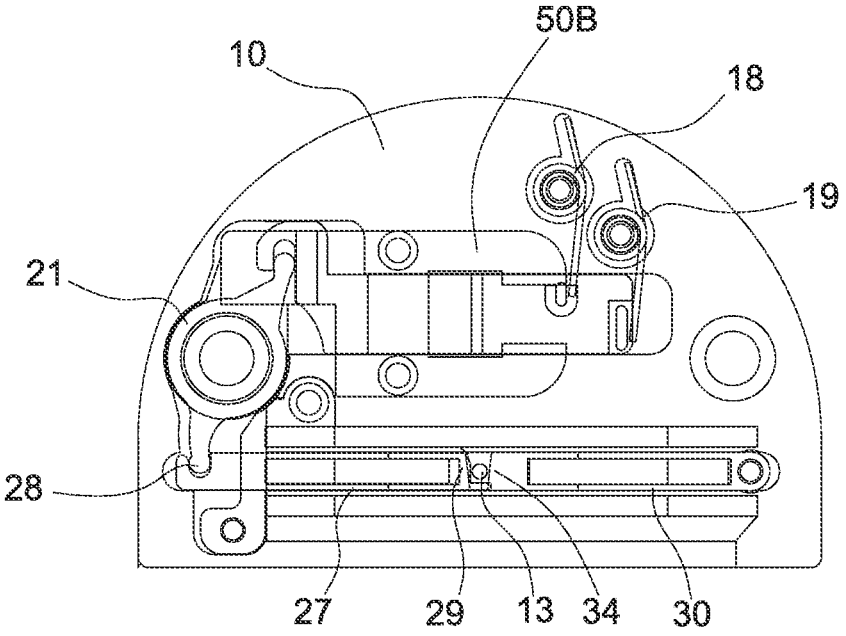
FIG. 12 is a side plan view showing the assembly of the automatic thread trimming device of the sewing machine according to a third embodiment of the present invention.

As shown in FIG. 12, in a third embodiment, an actuation element 50B is symmetrically and horizontally arranged on the holding disc 10 in a left driving mode so that the movable blade 29 of the movable cutter 27 is moved to the fixed blade 34 horizontally so as to be applicable for sewing machines of various brands.

Figure 13:
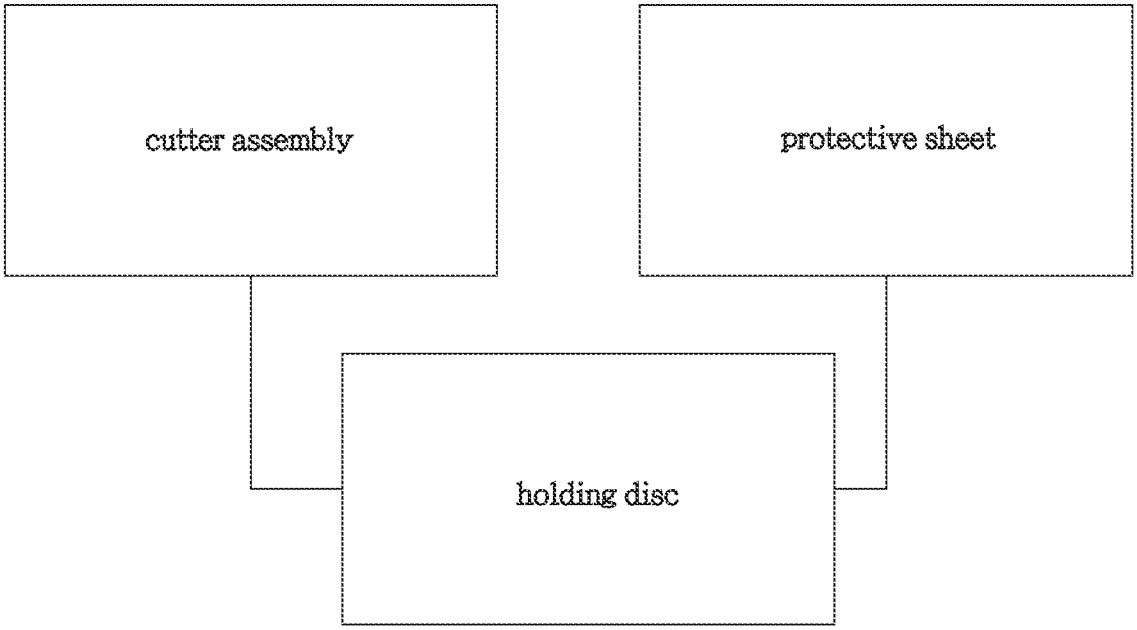
FIG. 13 is a block diagram of the automatic thread trimming device of the sewing machine according to a fourth embodiment of the present invention.

As illustrated in FIG. 13, in a fourth embodiment, a holding disc 10 is driven by a cutter assembly 20 and a protective sheet 40.

Thereby, the automatic thread trimming device is capable of being driven by actuation elements 50 of any sewing machines.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention,

What is claimed is:

1. An automatic thread trimming device of a sewing machine comprising:

a holding disc including a groove in which a protrusion extending from a predetermined position of the groove, a receiving orifice formed on a predetermined position of the protrusion, an accommodation portion formed beside the receiving orifice, and a coupling portion formed on a side of the accommodation portion, wherein the groove has a first defining orifice and a second defining orifice which are formed on two predetermined positions of the groove, and a first connection portion and a second connection portion are formed on two ends of the groove, wherein the first connection portion has a first flexible connection element, and second connection portion has a second flexible connection element;

wherein a cutter assembly is slidably received in the groove of the holding disc, and the cutter assembly includes a drive bar and a movable blade, wherein the movable blade has a guide rib extending from a side thereof, a tiled guiding face formed on a bottom of the guide rib, and an abutting section formed on a top of the movable blade, such that the movable blade is slidably aligned with the receiving orifice of the holding disc, wherein the cutter assembly further includes a trench corresponding to the second flexible connection element, and the cutter assembly includes a push face corresponding to the first flexible connection element, such that the trench of the cutter assembly is engaged with the first flexible connection element, and the push face of the cutter assembly abuts against the second flexible connection element;

wherein a fixed cutter is mounted in the accommodation portion of the holding disc, and the cutter assembly includes an arcuate guiding face formed on an end of the cutter assembly and corresponding to the receiving orifice of the holding disc, wherein the arcuate guiding face has a fixed blade formed on an end thereof and corresponding to the movable blade, such that the movable blade moves to the receiving orifice with the fixed blade to cut a thread, wherein the arcuate guiding face contacts with the tiled guiding face of the movable blade after the movable blade moves, the fixed cutter further includes a fixing segment formed on an end thereof and corresponding to the coupling portion of the holding disc, and the coupling portion of the holding disc is screwed with the fixing segment of the fixed cutter by using a first threaded bolt;

wherein a protective sheet includes multiple through holes corresponding to multiple defining orifices, such that the multiple defining orifices and the multiple through holes of the protective sheet are screwed by way of a second threaded bolt and at least a third threaded bolt, and the protective sheet covers the cutter assembly, wherein the protective sheet includes a stop face corresponding to the drive bar, such that the drive bar is limited on the stop face;

wherein the protective sheet further includes an elastic extension extending therefrom and corresponding to the movable blade, the elastic extension has a flexible curved section bending downward from a front end thereof, and the flexible curved section has a flexible biasing segment formed on a distal end thereof and corresponding to the abutting section of the movable cutter, the movable blade is pressed longitudinally by using the abutting section and the flexible biasing segment of the elastic extension, such that the movable blade accumulates an elasticity to bounce away, and the movable blade produces a cutting force with the fixed blade, when moving to the fixed blade horizontally.

2. The automatic thread trimming device as claimed in claim 1, wherein the groove of the holding disc has a first conduit, a second conduit, and a communication portion which are formed in a U shape, the cutter assembly further includes a driver and a movable cutter, the driver corresponds to the first conduit of the holding disc, and the movable cutter corresponds to the second conduit, wherein a locking segment and a fixing notch are defined between the driver and the movable cutter and are received in the communication portion.

3. The automatic thread trimming device as claimed in claim 1, wherein the drive bar has an actuation face formed on a rear end thereof and configured to drive the cutter assembly.

4. The automatic thread trimming device as claimed in claim 1, wherein the protective sheet includes a first through hole of the multiple through holes corresponding to the first defining orifice of the multiple defining orifices, and the protective sheet includes a second through hole of the multiple through holes corresponding to the second defining orifice of the multiple defining orifices, such that the first defining orifice and the first through hole are screwed by way of the second threaded bolt, the second defining orifice and the second through hole are screwed by way of the third threaded bolt.

5. The automatic thread trimming device as claimed in claim 1, wherein the first flexible connection element has a-threaded bolt, a first washer, a first resilient spring, and a first aperture defined on a center of the first resilient spring and configured to receive the threaded bolt of the first flexible connection element so that the threaded bolt of the first flexible connection element is rotatably accommodated in a first connecting extension of the holding disc, the first washer is fixed between the first connecting extension and the first resilient spring, wherein the first resilient spring has a first limiting segment and a first engaging segment, the first limiting segment abuts against a first defining fringe of the holding disc and the first engaging segment contacts with the push face of the cutter assembly; the second flexible connection element has a threaded bolt, a second washer, a second resilient spring, and a second aperture defined on a center of the second resilient spring and configured to receive the threaded bolt of the second flexible connection element so that the threaded bolt of the second flexible connection element is rotatably accommodated in a second connecting extension of the holding disc, the second washer is fixed between the second connecting extension and the second resilient spring, wherein the second resilient spring has a second limiting segment and a second engaging segment, wherein the second limiting segment abuts against a second defining fringe of the holding disc, and the second engaging segment contacts with the trench of the cutter assembly.

6. The automatic thread trimming device as claimed in claim 1, wherein the protrusion has an arcuate face corresponding to the receiving orifice.

7. The automatic thread trimming device as claimed in claim 1, wherein a longitudinal thickness of the protrusion corresponding to the receiving orifice is 0.5 mm.

* * * * *